US009711897B2

(12) United States Patent
Ho

(10) Patent No.: US 9,711,897 B2
(45) Date of Patent: Jul. 18, 2017

(54) UVA BATTERY CONNECTOR

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/231,033

(22) Filed: Aug. 8, 2016

(65) Prior Publication Data

US 2017/0047682 A1 Feb. 16, 2017

(30) Foreign Application Priority Data

Aug. 13, 2015 (CN) ..... 2015 1 0498478

(51) Int. Cl.
*H01R 13/631* (2006.01)
*H01R 13/04* (2006.01)

(52) U.S. Cl.
CPC ..... *H01R 13/631* (2013.01); *H01R 13/04* (2013.01)

(58) Field of Classification Search
CPC .... H01R 13/631; H01R 13/04; H01R 9/2608; H01R 13/629; H01R 25/162; H01R 25/14; H01R 13/4223; H01R 13/4226
USPC ..... 439/374, 378, 845, 849, 850, 64, 65, 66, 439/545, 844, 541.5, 660, 74, 79, 91, 82, 439/83
See application file for complete search history.

(56) References Cited

U.S. PATENT DOCUMENTS 5,192,232 A * 3/1993 Lenz ..... H01R 12/716 439/660
6,319,075 B1 * 11/2001 Clark ..... H01R 13/11 439/65
6,471,523 B1 * 10/2002 Shuey ..... H01R 13/112 439/63
7,422,451 B2 9/2008 Chen et al.
7,488,217 B2 * 2/2009 Cheng ..... H01R 13/11 439/668
7,802,994 B1 * 9/2010 Chen ..... H01R 12/58 439/65
7,905,731 B2 * 3/2011 Ngo ..... H01R 12/585 439/75

(Continued)

FOREIGN PATENT DOCUMENTS

CN 202454786 U 9/2012
TW M31167 U 5/2007

*Primary Examiner* — Harshad Patel
(74) *Attorney, Agent, or Firm* — James A. O'Malley

(57) ABSTRACT

An electrical connection device and a terminal are provided. The electrical connection device includes first and second connectors. The first connector includes an insulating body and a plurality of blade-type terminals. The insulating body has a base portion and two ear portions, an inner wall surface of the ear portion has a first guide groove which is perpendicular to the base portion and a second guide groove which is parallel to the base portion. The second connector includes an insulating housing and a plurality of elastic terminals. The insulating housing has a mating portion and a protruding rail, the mating portion has a plurality of terminal grooves respectively provided with the elastic terminals. When the connectors are mated, each contact portion can contact the guide portion of the corresponding elastic terminal and then contact the contact portion of the corresponding elastic terminal to prevent the elastic terminal from being damaged.

10 Claims, 12 Drawing Sheets

(56) References Cited

U.S. PATENT DOCUMENTS

| | | | | |
|---|---|---|---|---|
| 8,267,724 | B2 * | 9/2012 | Dodds | H01R 12/724<br>439/660 |
| 2010/0041266 | A1 * | 2/2010 | Data | H01R 12/7088<br>439/358 |
| 2013/0090001 | A1 * | 4/2013 | Kagotani | H01R 13/60<br>439/378 |

* cited by examiner

UVA BATTERY CONNECTOR

RELATED APPLICATIONS

This application claims priority to Chinese Application No. 201510498478.6, filed Aug. 13, 2015, which is incorporated herein by reference in its entirety.

TECHNICAL FIELD

The present disclosure relates to an electrical connection device, and particularly relates to an electrical connection device having two mating directions.

BACKGROUND ART

Generally a mating connector which may have two directions, for example, as disclosed in Chinese patent issued publication No. CN202454786U, comprises: a first insulating body provided with a plurality of terminal grooves, each terminal groove has a horizontal opening opened in a horizontal direction and a vertical opening opened in a vertical direction, each terminal groove is correspondingly provided with a clamping arm-type terminal; and a second insulating body provided with a plurality of blade-type terminals respectively mating with the plurality of clamping arm-type terminals. Two sides of the first insulating body each are provided with a first guide groove which is in the same direction as the horizontal opening of the terminal groove and a second guide groove which is in the same direction as the vertical opening of the terminal groove, and two sides of the second insulating body each are provided with a positioning protrusion. When the first insulating body and the second insulating body mates with each other in the horizontal direction, the positioning protrusion enters into the first guide groove, and the blade-type terminal enters into the terminal groove via the horizontal opening to mate with the clamping arm-type terminal; when the first insulating body and the second insulating body mate with each other in the vertical direction, the positioning protrusion enters into the second guide groove, and the blade-type terminal enters into the terminal groove via the vertical opening to mate with the clamping arm-type terminal.

Since the blade-type terminal will enter into the terminal groove via the horizontal opening or the vertical opening to mate with the clamping arm-type terminal, that is, the blade-type terminal will mates with the clamping arm-type terminal in the two directions, in order to avoiding the blade-type terminal crashing the clamping arm-type terminal, a spherical bulge is provided on a contact portion of the clamping arm-type terminal to contact the blade-type terminal. However, the spherical bulge is generally formed by stamping a metal sheet to make a part of the metal sheet curved so as to protrude at a side and be recessed at an opposite side so that the inside of the spherical bulge is hollow, the spherical bulge is easily recessed from the protruding side toward the inside of the spherical bulge and plastically deformed and in turn be damaged after many times collisions. So such a mating connector cannot bear high times of plug, for example, more than ten thousand times of plug.

SUMMARY

Therefore, the present disclosure provides an electrical connection device with resistance to plug.

The present disclosure further provides a terminal which can increase a soldering area to make soldering more firm.

Accordingly, in some embodiments, an electrical connection device of the present disclosure comprises a first connector and a second connector. The first connector comprises an insulating body and a plurality of blade-type terminals. The insulating body has a base portion which is longitudinally long and two ear portions which perpendicularly protrude respectively from two ends of the base portion, are spaced apart from each other and face each other, an inner wall surface of one of the two ear portions is provided with a first guide groove which is perpendicular to the base portion and a second guide groove which is parallel to the base portion. The plurality of blade-type terminals are provided to the base portion along a longitudinal direction of the base portion, spaced apart from each other and positioned between the two ear portions, each blade-type terminal has a contact portion extending out of the base portion and positioned between the two ear portions. The second connector comprises an insulating housing and a plurality of elastic terminals. The insulating housing has a mating portion and a protruding rail, the mating portion is correspondingly received between the two inner wall surfaces of the two ear portions of the first connector, and the mating portion has two long side surfaces respectively positioned at two sides of a longitudinal direction, two short side surfaces respectively positioned at two ends of the longitudinal direction and connecting the two long side surfaces, a top surface connecting the two long side surfaces and the two short side surfaces and a plurality of terminal grooves spaced apart from each other along the longitudinal direction of the mating portion, each terminal groove has a mating opening at the top surface and a side opening at one of the two long side surfaces, the protruding rail protrudes from one of the two short side surfaces and extends in a direction perpendicular to the top surface to engage with the first guide groove or the second guide groove. The plurality of elastic terminals are provided to the insulating housing and respectively received in the plurality of terminal grooves, each elastic terminal has a contact portion positioned in the mating portion and a guide portion extending from the contact portion toward the top surface. When the first connector and the second connector mate with each other in a first direction, under guiding due to engagement of the first guide groove of the first connector and the protruding rail of the second connector, the contact portions of the plurality of blade-type terminals respectively enter into the plurality of terminal grooves respectively via the mating openings of the plurality of terminal grooves and each contact portion can firstly contact the guide portion of the corresponding elastic terminal and then contact the contact portion of the corresponding elastic terminal. When the first connector and the second connector mate with each other in a second direction, under guiding due to engagement of the second guide groove of the first connector and the protruding rail of the second connector, the contact portions of the plurality of blade-type terminals respectively enter into the plurality of terminal grooves respectively via mating openings of the plurality of terminal grooves and each contact portion can firstly contact the guide portion of the corresponding elastic terminal and then contact the contact portion of the corresponding elastic terminal.

In some embodiments, the protruding rail is adjacent to the long side surface provided with the side openings of the plurality of terminal grooves, the mating portion cannot enter into between the two ear portions from the long side surface provided with the side openings of the plurality of terminal grooves, so as to prevent the plurality of blade-type terminals from respectively entering into the plurality of terminal groove respectively via the plurality of side openings.

In some embodiments, an inner wall surface of the other ear portion of the insulating body is also provided with a first guide groove which is perpendicular to the base portion and a second guide groove which is parallel to the base portion, the two first guide grooves of the two ear portions are aligned with each other in position and the two second guide grooves of the two ear portions are aligned with each other in position; the insulating housing further has a protruding rail protruding from the other short side surface, the two protruding rails are aligned with each other in position.

In some embodiments, the two protruding rails are adjacent to the long side surface provided with the side openings of the plurality of terminal grooves, the mating portion cannot enter into between the two ear portions from the long side surface provided with the side openings, so as to prevent the plurality of blade-type terminals from respectively entering into the plurality of terminal grooves respectively via the plurality of side openings.

In some embodiments, each elastic terminal has a group of elastic clamping arms which face each other and extend toward the top surface, a distal section of each of the elastic clamping arms which are positioned respectively at two facing sides is firstly bent inwardly toward the inside of the two facing sides and then bent outwardly toward the outside of the two facing sides along an extension direction of the distal section and extends to form the contact portion and the guide portion, the contact portion of the elastic terminal is used for clamping the contact portion of the corresponding blade-type terminal.

In some embodiments, each elastic terminal further has a fixed portion and two soldering piece portions, the fixed portion has two main sections spaced apart from each other and facing each other and a connecting section connecting the two main sections, the group of elastic clamping arms respectively extend from the two main sections toward the top surface, the two soldering piece portions respectively extend from the two main sections toward a direction away from the top surface, and the two soldering piece portions are firstly bent relative to each other so as to approach each other and then extend straight, and the two soldering piece portions are offset and arranged side by side.

In some embodiments, the first connector further comprises two fixing members respectively provided in the two ear portions and passing through and protrude from the base portion.

In some embodiments, the two fixing members are the same as the plurality of blade-type terminals in structure.

Accordingly, in some embodiments, a terminal of the present disclosure is integrally formed by a metal sheet, comprises a fixed portion, a group of elastic clamping arms and two soldering piece portions. The fixed portion has two main sections which are spaced apart from each other and face each other and a connecting section connecting the two main sections. The group of elastic clamping arms each extend from one side of one of the two main sections. The two soldering piece portions each extend from another side of one of the two main sections toward a direction opposite to the group of elastic clamping arms, and the two soldering piece portions are firstly bent relative to each other so as to approach each other and then extend straight, and the two soldering piece portions are offset and arranged side by side.

In some embodiments, a distal section of each of elastic clamping arms which are positioned respectively at two facing sides is firstly bent inwardly toward the inside of the two facing sides and then bent outwardly toward the outside of the two facing sides along an extension direction of the distal section and extends to form a contact portion and a guide portion.

The present disclosure at least has the following effects: under guiding mating of the first connector and the second connector by that the first guide groove or the second guide groove of the first connector engages with the protruding rail of the second connector, whether the first connector and the second connector mate with each other in the first direction or the second direction, the contact portions of the blade-type terminals of the first connector can respectively enter into the terminal grooves respectively via the mating openings of the terminal grooves so as to prevent the elastic terminals from being damaged. Moreover, the elastic terminal may form the guide portion extending in single direction by bending, the elastic terminal is easy to manufacture and has stronger structural strength, and may bear high times of plug. In addition, the elastic terminal has two soldering piece portions offset and arranged side by side, it can increase the soldering area to make soldering more firm.

BRIEF DESCRIPTION OF THE DRAWINGS

The other features and effects of the present disclosure will be apparent through detailed description of embodiments with referring to the Figures, and in which.

DETAILED DESCRIPTION OF THE PREFERRED EMBODIMENTS

Figure 1:
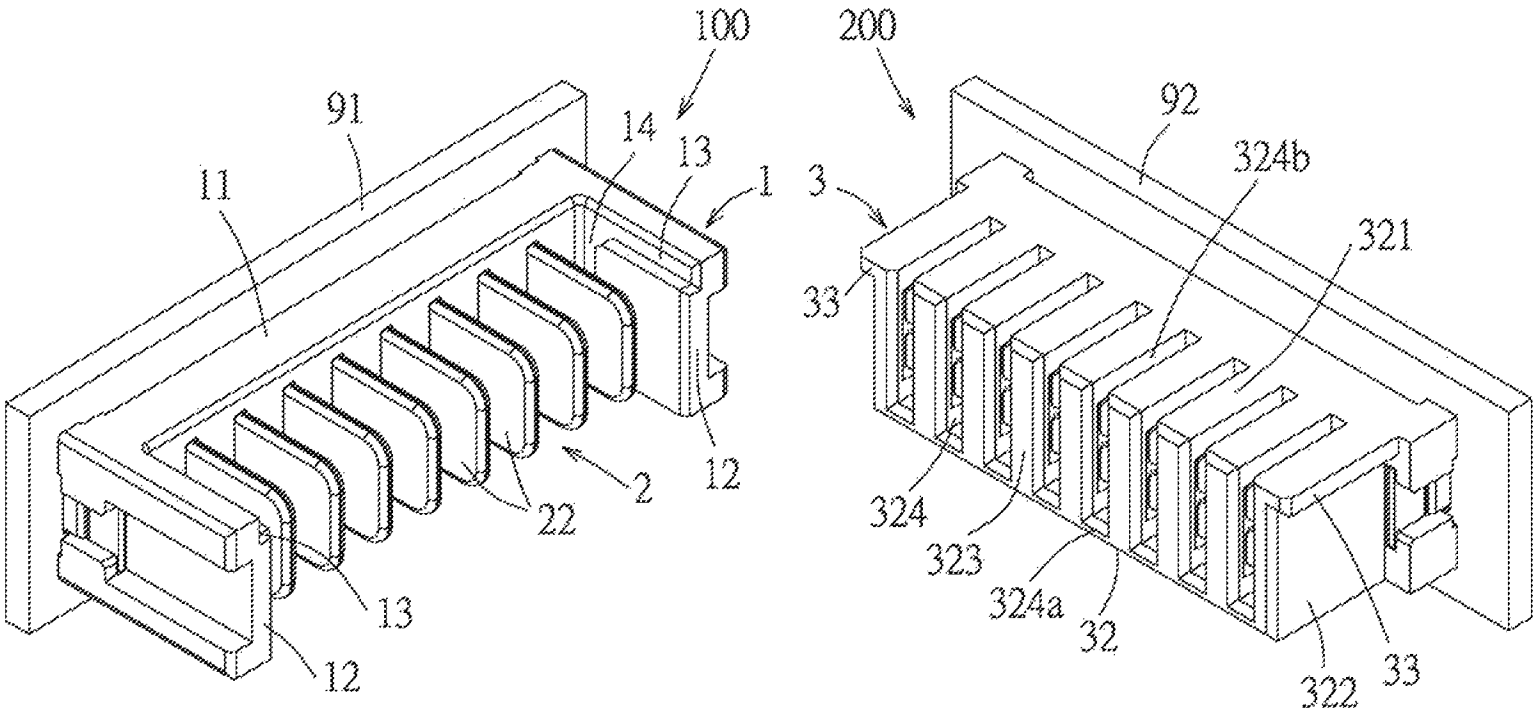
FIG. 1 is an exploded perspective view illustrating a first embodiment of an electrical connection device of the present disclosure in a state that a first connector and a second connector are in unmated state.

Before the present disclosure is described in detail, it should be noted that similar element is indicated by the same reference numeral in the following description.

Referring to FIG. 1, an electrical connection device of a first embodiment of the present disclosure comprises a first connector 100 and a second connector 200. In the embodiment, the first connector 100 is provided to a first circuit board 91, the second connector 200 is provided to a second circuit board 92.

Figure 2:
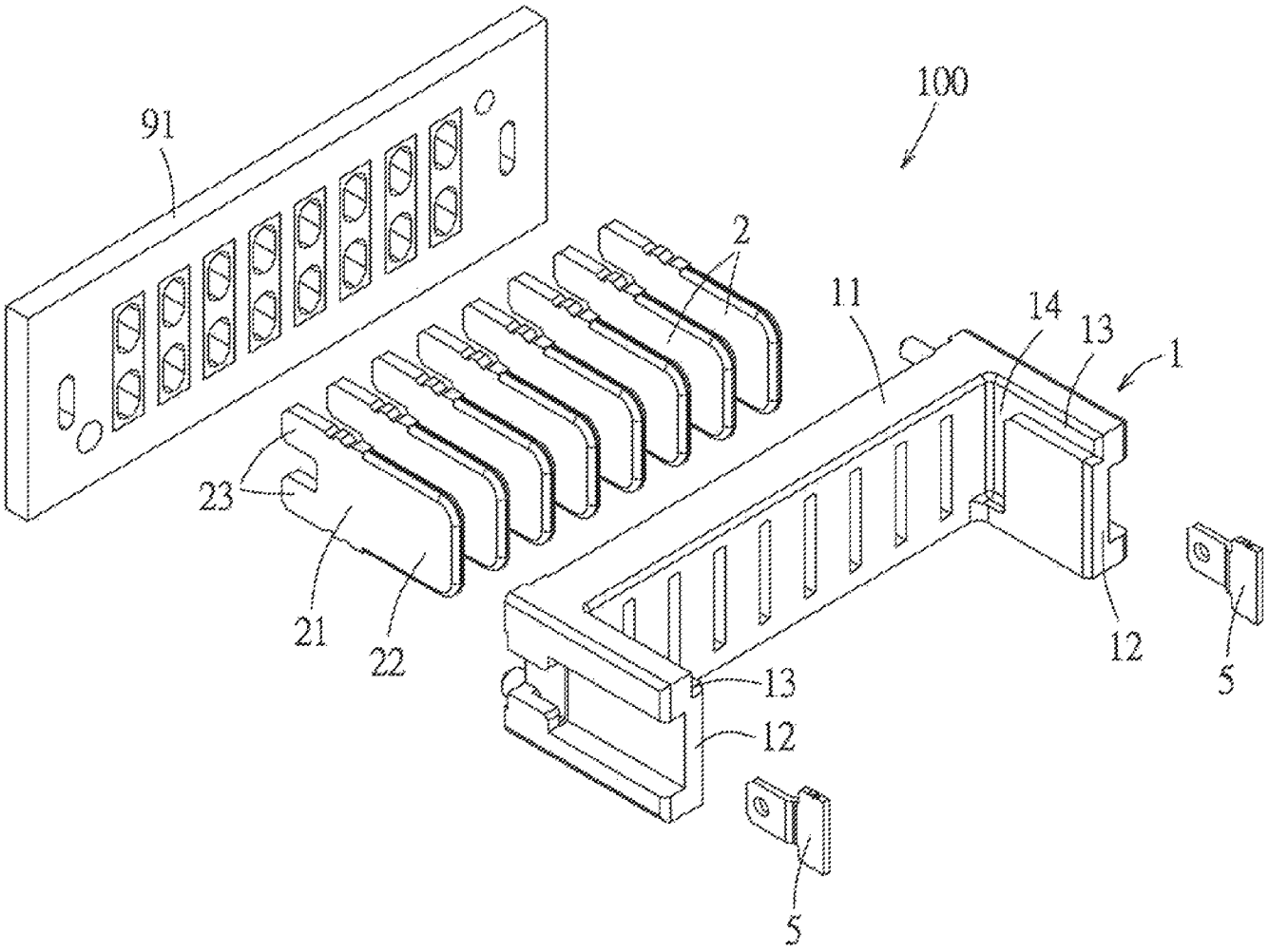
FIG. 2 is an exploded perspective view illustrating an assembling relationship between components of the first connector of the first embodiment and a first circuit board.
Figure 3:
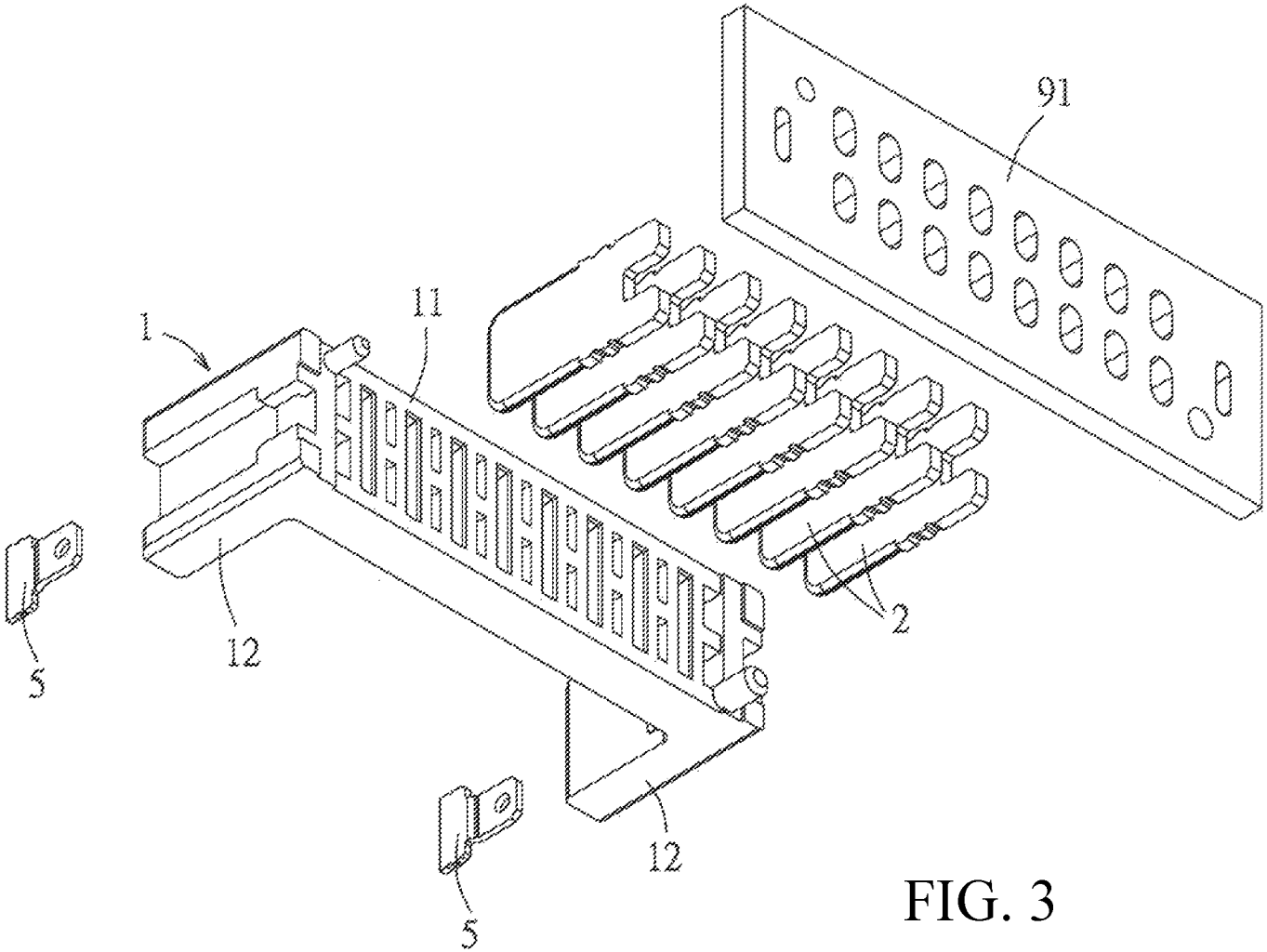
FIG. 3 is a view of FIG. 2 viewed from another angle.

Referring to FIG. 1 to FIG. 3, the first connector 100 comprises an insulating body 1, a plurality of blade-type terminals 2 and two fixing members 5. The insulating body 1 has a base portion 11 which is longitudinally long and two ear portions 12 which perpendicularly protrude respectively from two ends of the base portion 11, are spaced apart from each other and face each other. In the embodiment, an inner wall surface of each ear portion 12 is provided with a first guide groove 13 which is perpendicular to the base portion 11 and a second guide groove 14 which is parallel to the base portion 11, the two first guide grooves 13 of the two ear portions 12 are aligned with each other in position, and the two second guide grooves 14 of the two ear portions 12 are aligned with each other in position. In the embodiment, for each ear portion 12, the first guide groove 13 and the second guide groove 14 are arranged to form a L-shape, the first guide groove 13 is adjacent to a side edge of the ear portion 12, the second guide groove 14 is adjacent to the base portion 11. In another embodiment, it may also be implemented that only one of the two ear portions 12 is provided with the first guide groove 13 and the second guide groove 14. The plurality of blade-type terminals 2 are provided to the base portion 11 along a longitudinal direction of the base portion 11, spaced apart from each other and positioned between the two ear portions 12. Each blade-type terminal 2 has a retention portion 21 retained in the base portion 11, a contact portion 22 extending out of the base portion 11 from one end of the retention portion 21 and positioned between the two ear portions 12 and two soldering legs 23 extending out of the base portion 11 from another end of the retention portion 21 and spaced apart from each other for being soldered to the first circuit board 91. In the embodiment, the two fixing members 5 are respectively provided to two ends of the base portion 11 so as to solder and fix the insulating body 1 to the first circuit board 91.

Figure 4:
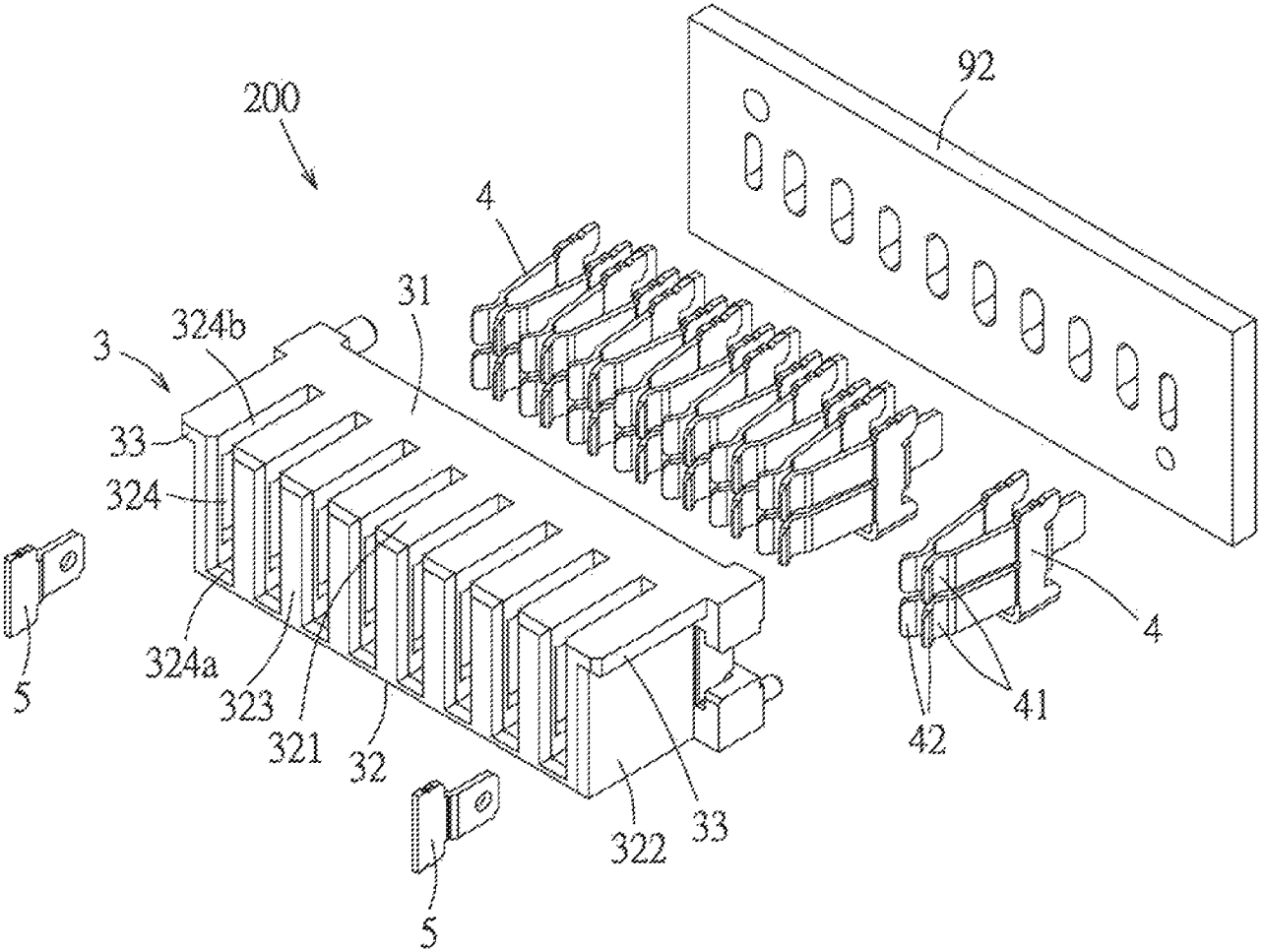
FIG. 4 is an exploded perspective view illustrating an assembling relationship between components of the second connector of the first embodiment and a second circuit board.
Figure 5:
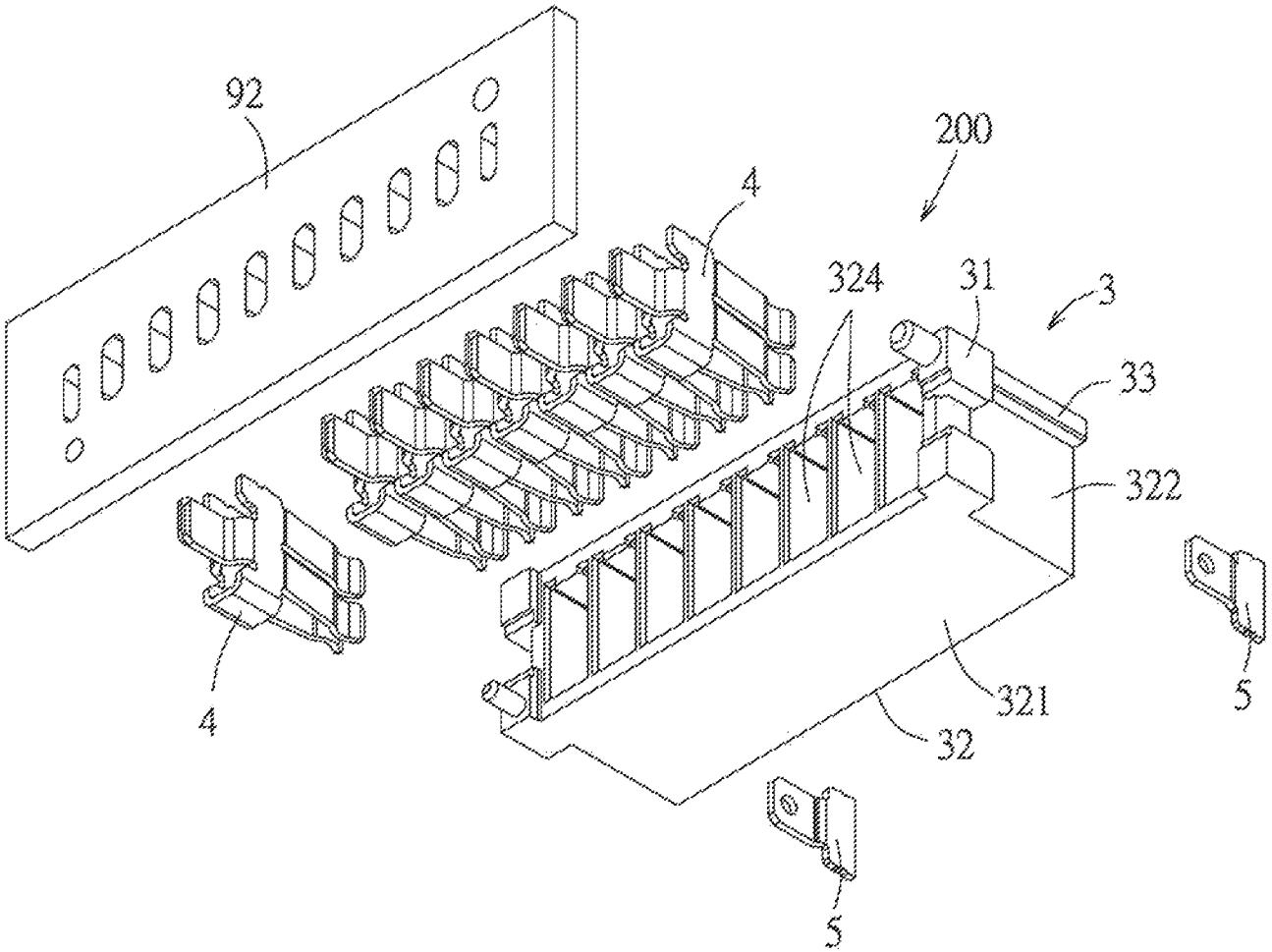
FIG. 5 is a view of FIG. 4 viewed from another angle.

Referring to FIG. 1, FIG. 4 and FIG. 5, the second connector 200 comprises an insulating housing 3, a plurality of elastic terminals 4 and two fixing members 5. In the embodiment, the insulating housing 3 has a base block 31, a mating portion 32 and two protruding rails 33. The two fixing members 5 are respectively provided to two ends of the base block 31 so as to be soldered to the second circuit board 92 so that the base block 31 is fixed to the second circuit board 92 via the two fixing members 5. The mating portion 32 protrudes from the base block 31 so as to be correspondingly received between the two inner wall surfaces of the two ear portions 12 of the first connector 100, and the mating portion 32 has two long side surfaces 321 respectively positioned at two sides of a longitudinal direction, two short side surfaces 322 respectively positioned at two ends of the longitudinal direction and connecting the two long side surfaces 321, a top surface 323 connecting the two long side surfaces 321 and the two short side surfaces 322 and a plurality of terminal grooves 324 spaced apart from each other along the longitudinal direction of the mating portion 32. Each terminal groove 324 has a mating opening 324*a* at the top surface 323 and a side opening 324*b* at one of the two long side surfaces 321. The two protruding rails 33 respectively protrude from the two short side surfaces 322 and extend in a direction perpendicular to the top surface 323 and the two protruding rails 33 are aligned with each other in position, so as to respectively engage with the two first guide grooves 13 or the two second guide grooves 14 provided to the two ear portions 12. That is, each protruding rail 33 engages with the first guide groove 13 or the second guide groove 14 of the corresponding ear portion 12, if only one of the two ear portions 12 is provided with the first guide groove 13 and the second guide groove 14, the insulating housing 3 only is provided with one protruding rail 33 at the short side surface 322 to which the only one ear portion 12 corresponds. In the embodiment, the two protruding rails 33 is adjacent to the long side surface 321 provided with the side openings 324*b* of the plurality of terminal grooves 324, that is, the two protruding rails 33 are respectively adjacent to two connecting positions between the two short side surfaces 322 and the long side surface 321 provided with the side openings 324*b*.

Figure 7:
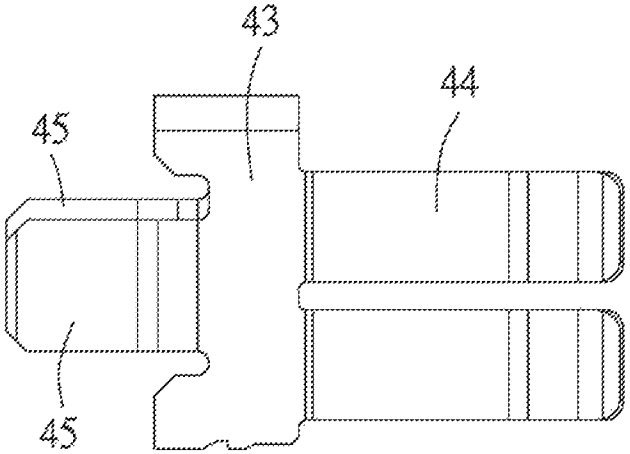
FIG. 7 is a side view illustrating that two soldering piece portions of the elastic terminal are offset from each other.
Figure 6:
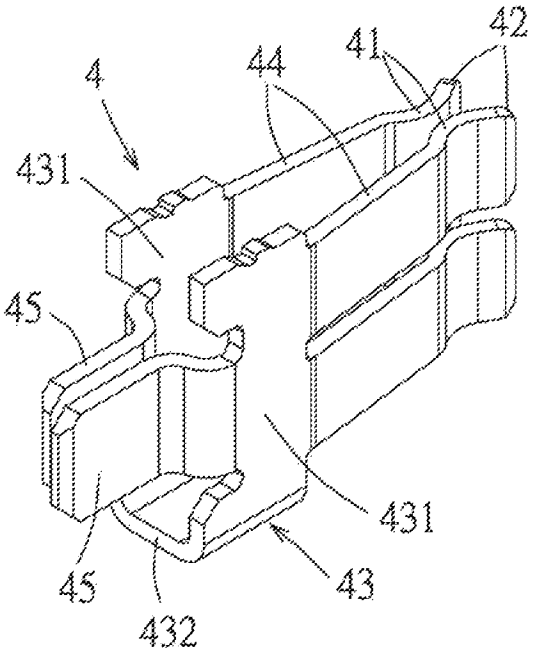
FIG. 6 is a perspective view illustrating an elastic terminal of the second connector of the first embodiment.

The plurality of elastic terminals 4 are provided to the insulating housing 3 and are respectively received in the plurality of terminal grooves 324. Each elastic terminal 4 has a contact portion 41 positioned in the mating portion 32 and a guide portion 42 extending from the contact portion 41 toward the top surface 323. Also referring to FIG. 6 and FIG. 7, in the embodiment, each elastic terminal 4 has a fixed portion 43, a group of elastic clamping arms 44 facing each other and two soldering piece portions 45. The fixed portion 43 has two main sections 431 spaced apart from each other and facing each other and a connecting section 432 connecting the two main sections 431. The group of elastic clamping arms 44 respectively extend from the two main section 431 toward the top surface 323, a distal section of each of the elastic clamping arms 44 which are positioned respectively at two facing sides is firstly bent inwardly toward the inside of the two facing sides and then bent outwardly toward the outside of the two facing sides along an extension direction of the distal section and extends to form the contact portion 41 and the guide portion 42, the contact portion 41 is used for clamping the contact portion 22 of the corresponding blade-type terminal 2. The two soldering piece portions 45 extend respectively from the two main sections 431 in a direction away from the top surface 323, and are firstly bent relative to each other so as to approach each other, and then extend straight, the two soldering piece portions 45 are used to solder to the second circuit board 92, and the two soldering piece portions 45 are offset and arranged side by side. That is, the group of elastic clamping arms 44 each extend from one side of one of the two main sections 431, the two soldering piece portions 45 each extend from another side of one of the two main section 431 toward a direction opposite to the group of elastic clamping arms 44, and the two soldering piece portions 45 are firstly bent relative to each other so as to approach each other and then extend straight, and the two soldering piece portions 45 are offset and arranged side by side. As shown in FIG. 6 and FIG. 7, the soldering piece portions 45 which are respectively positioned at the left and the right are offset at the upper and the lower, as shown in FIG. 7 which is a side view, the two soldering piece portions 45 are not partially overlapped at the upper and the lower, so it can increase a soldering area to make soldering more firm. In the embodiment, the elastic terminal 4 has one group of elastic clamping arms 44, and the two elastic clamping arms 44 are arranged on each of the left and the right, in other embodiments, one elastic clamping arm 44 can be arranged on each of the left and the right or the elastic terminal 4 only has one elastic clamping arm 44 as long as the elastic clamping arm 44 can form the guide portion 42 and the contact portion 41, the present disclosure is not limited to this.

Figure 9:
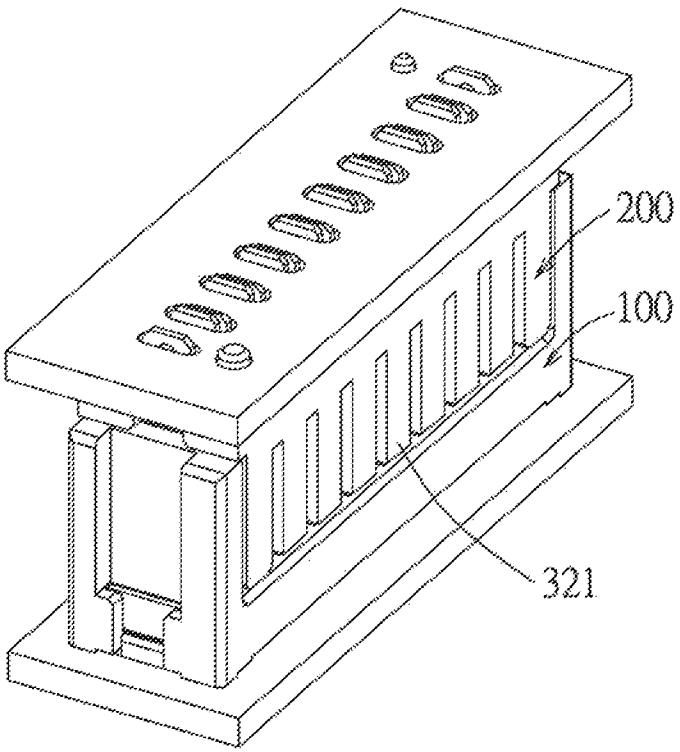
FIG. 9 is a perspective view illustrating an assembled state that the first connector and the second connector of the first embodiment are mated in the first direction.
Figure 8:
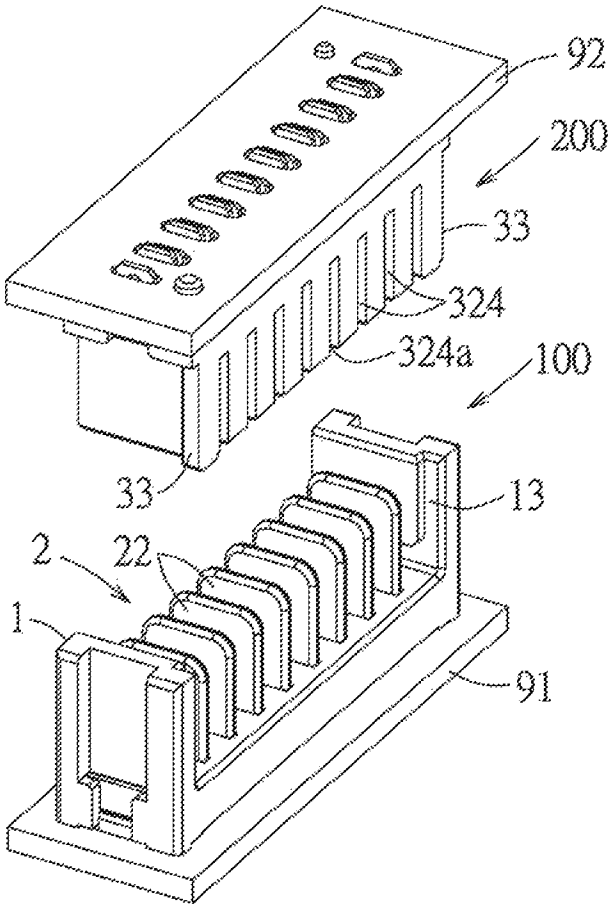
FIG. 8 is an exploded perspective view illustrating a mating relationship between the first connector and the second connector of the first embodiment in a first direction.

Referring to FIG. 8 and FIG. 9, when the first connector 100 and the second connector 200 mate with each other in a first direction, under guiding due to engagement of the first guide groove 13 of the first connector 100 and the protruding rail 33 of the second connector 200, the contact portions 22 of the plurality of blade-type terminals 2 are respectively inserted into the plurality of terminal grooves 324 respectively via the mating openings 324*a* of the plurality of terminal grooves 324 and each contact portion 22 can firstly contact the guide portion 42 of the corresponding elastic terminal 4 (see FIG. 4) and then contact the contact portion 41 of the corresponding elastic terminal 4.

Figure 11:
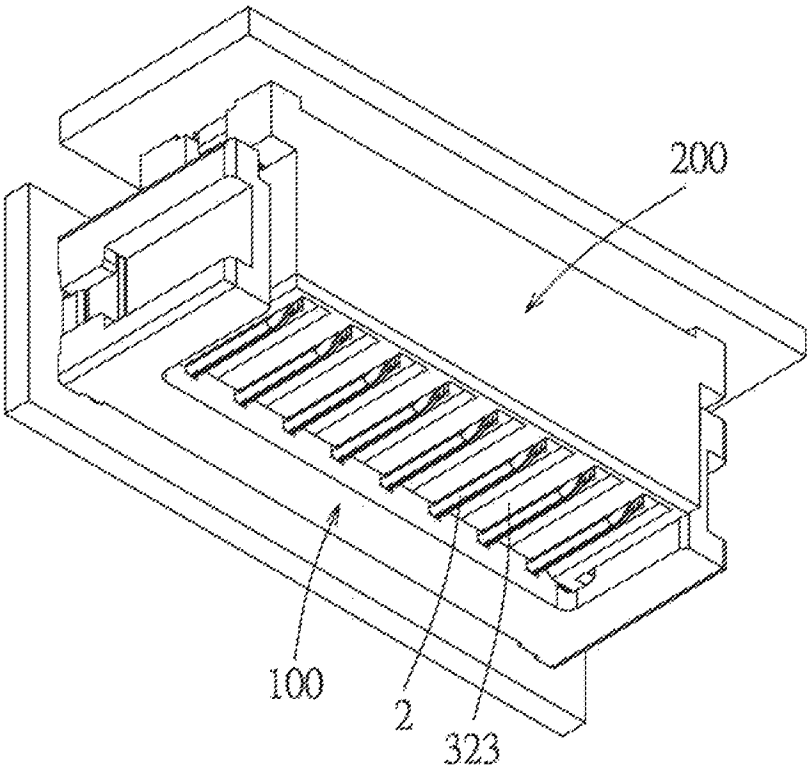
FIG. 11 is a perspective vie illustrating an assembled state of the first connector and the second connector of the first embodiment are mated in the second direction.
Figure 10:
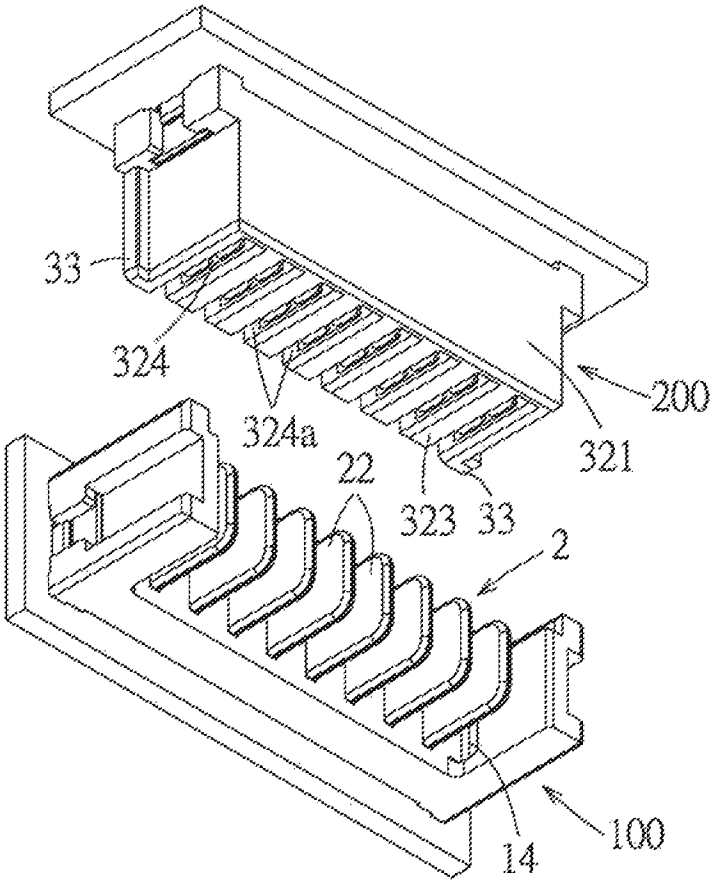
FIG. 10 is an exploded perspective view illustrating a mating relationship between the first connector and the second connector of the first embodiment in a second direction.

Referring to FIG. 10 and FIG. 11, when the first connector 100 the second connector 200 mate with each other in a second direction, under guiding due to engagement of the second guide groove 14 of the first connector 100 and the protruding rail 33 of the second connector 200, the contact portions 22 of the plurality of blade-type terminals 2 are respectively inserted into the plurality of terminal grooves 324 respectively via the mating openings 324*a* of the plurality of terminal grooves 324 and each the contact portion 22 can firstly contact the guide portion 42 of the corresponding elastic terminal 4 (see FIG. 4) and then contact the contact portion 41 of the corresponding elastic terminal 4.

That is, whether the first connector 100 and the second connector 200 mate with each other in the first direction or the second direction, the contact portion 22 of the blade-type terminal 2 of the first connector 100 is inserted into the corresponding terminal groove 324 via the mating opening 324*a* of the corresponding terminal groove 324 and in turn can firstly contact the guide portion 42 of the corresponding elastic terminal 4 and then contact the contact portion 41 of the corresponding elastic terminal 4, which could prevent the blade-type terminal 2 from colliding the elastic terminal 4 in a side direction of the elastic terminal 4 toward the long side surface 321 (without guiding of the guide portion 42), and further prevent the elastic terminal 4 from being damaged. Moreover, the elastic terminal 4 may form the guide portion 42 extending along a single direction by bending, the elastic terminal 4 is easy to manufacture and has stronger structural strength, and may bear high times of plug.

Figure 12:
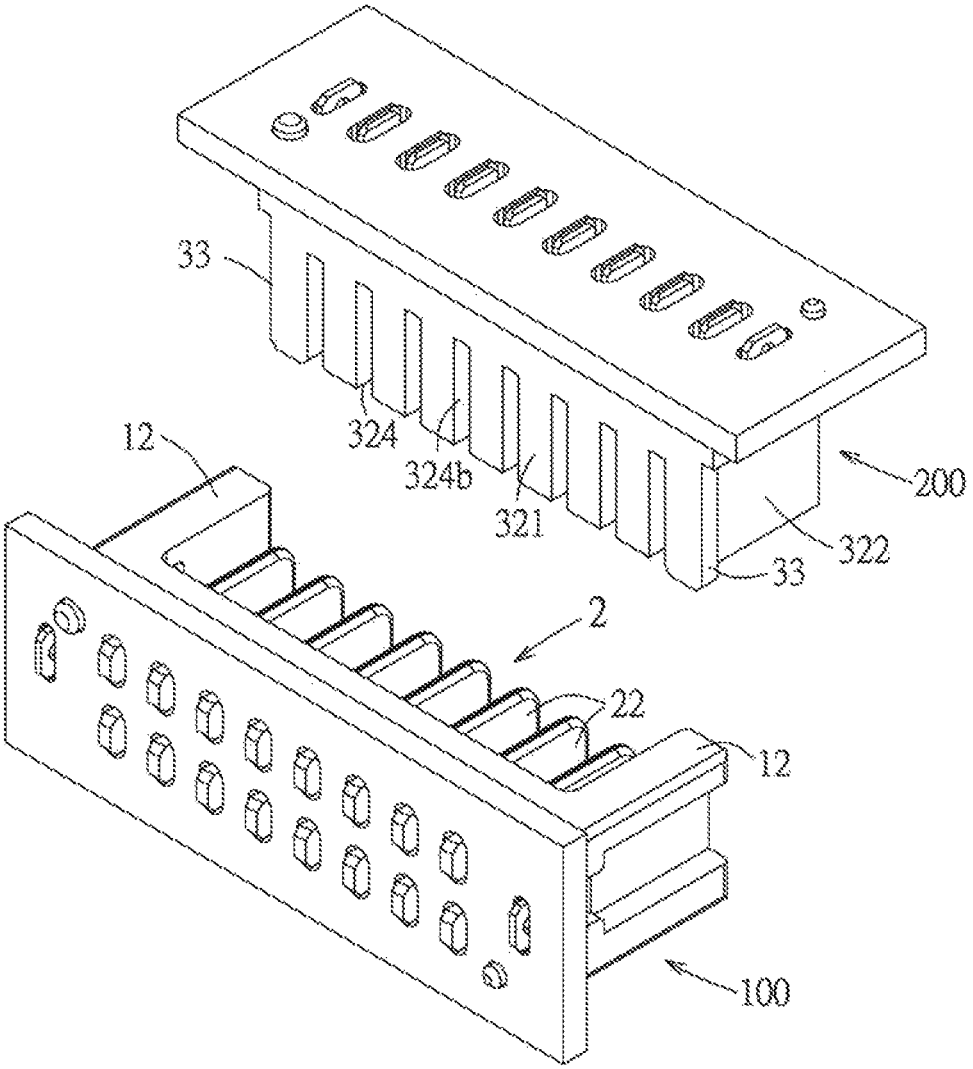
FIG. 12 is an exploded perspective view illustrating an improper mating relationship between the first connector and the second connector.

Referring to FIG. 12, in the embodiment, the two protruding rails 33 are adjacent the long side surface 321 provided with the side openings 324*b* of the plurality of terminal grooves 324, the mating portion 32 cannot enter into between the two ear portions 12 from the long side surface 321 provided with the side openings 324*b*, so as to prevent the contact portions 22 of the plurality of blade-type terminals 2 from respectively entering into the plurality of terminal grooves 324 respectively via the plurality of side openings 324*b*. As shown in FIG. 12, since the two protruding rails 33 respectively protrude from the two short side surfaces 322 and are adjacent to the long side surface 321 provided with the side openings 324*b*, it is equivalent to increase a length of the long side surface 321 provided with the side openings 324*b*, an overall length of the long side surface 321 is larger than a distance between the two inner wall surfaces of the two ear portions 12 of the first connector 100, so when a user make the first connector 100 and the second connector 200 to be mated with each other via the plurality of side openings 324*b*, the two protruding rails 33 will respectively abut against the two ear portions 12, the contact portions 22 of the blade-type terminals 2 cannot respectively enter into the terminal grooves 324 respectively via the side openings 324*b* and cannot respectively damage the elastic terminals 4, to achieve a fool-proof function (that is a prevent improper insertion function). Similarly, if only one protruding rail 33 is provided and is adjacent to the long side surface 321 provided with the side openings 324*b* of the plurality of terminal grooves 324, in the same principle, it can also prevent the contact portions 22 of the plurality of blade-type terminals 2 from respectively entering into the plurality of terminal grooves 324 respectively via the plurality of side openings 324*b*.

Figure 13:
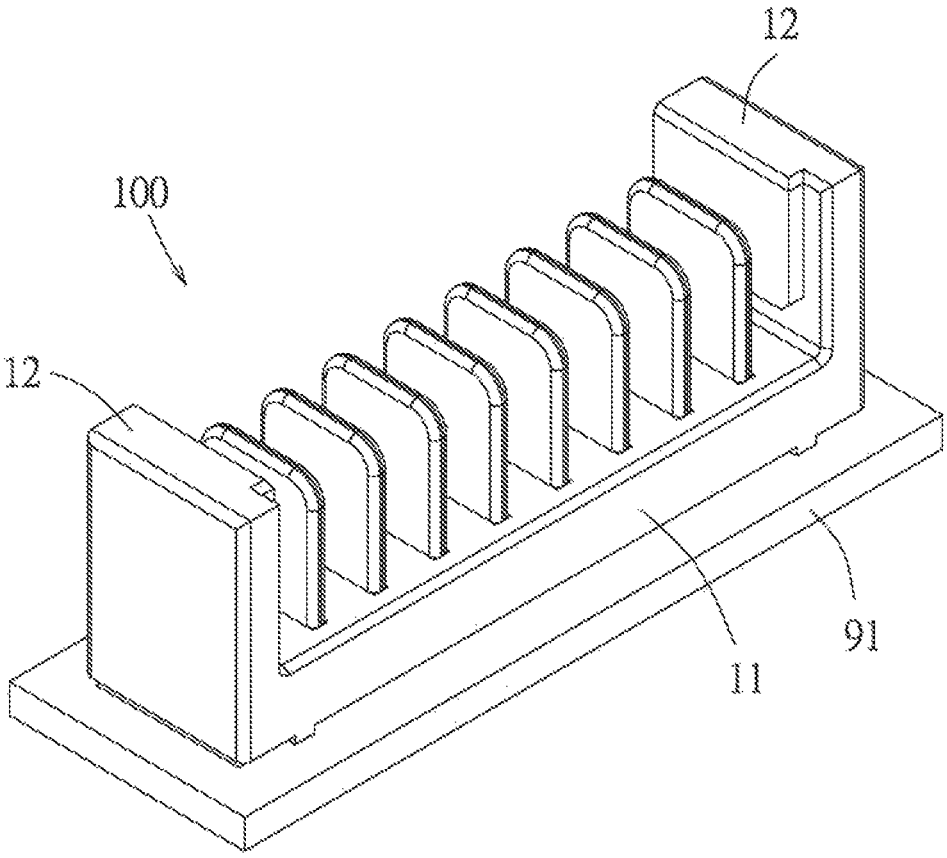
FIG. 13 is a perspective view illustrating a first connector of a second embodiment of the electrical connection device of the present disclosure.
Figure 14:
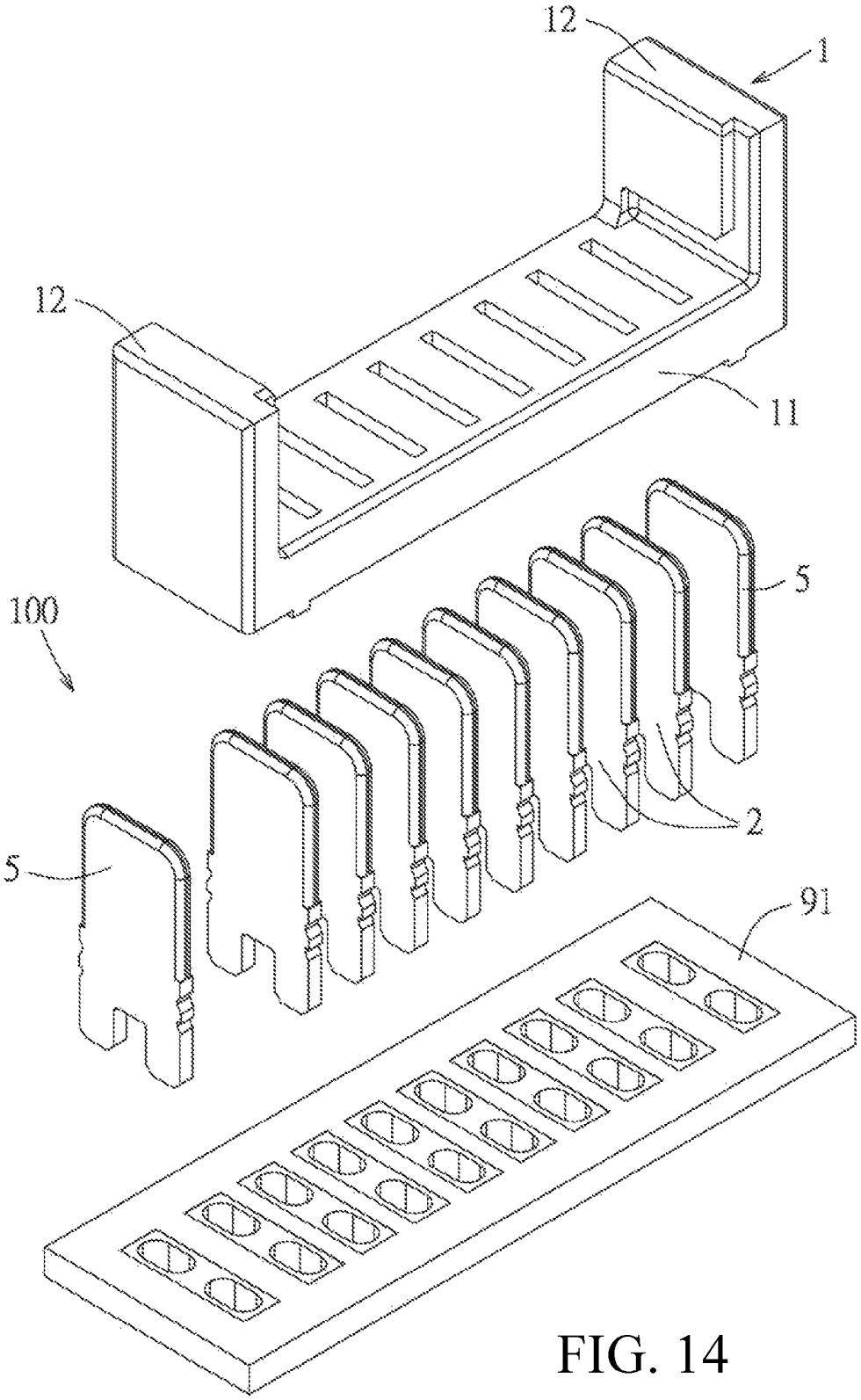
FIG. 14 is an exploded perspective view illustrating components of the first connector of the second embodiment and an assembling relationship of the components.
Figure 15:
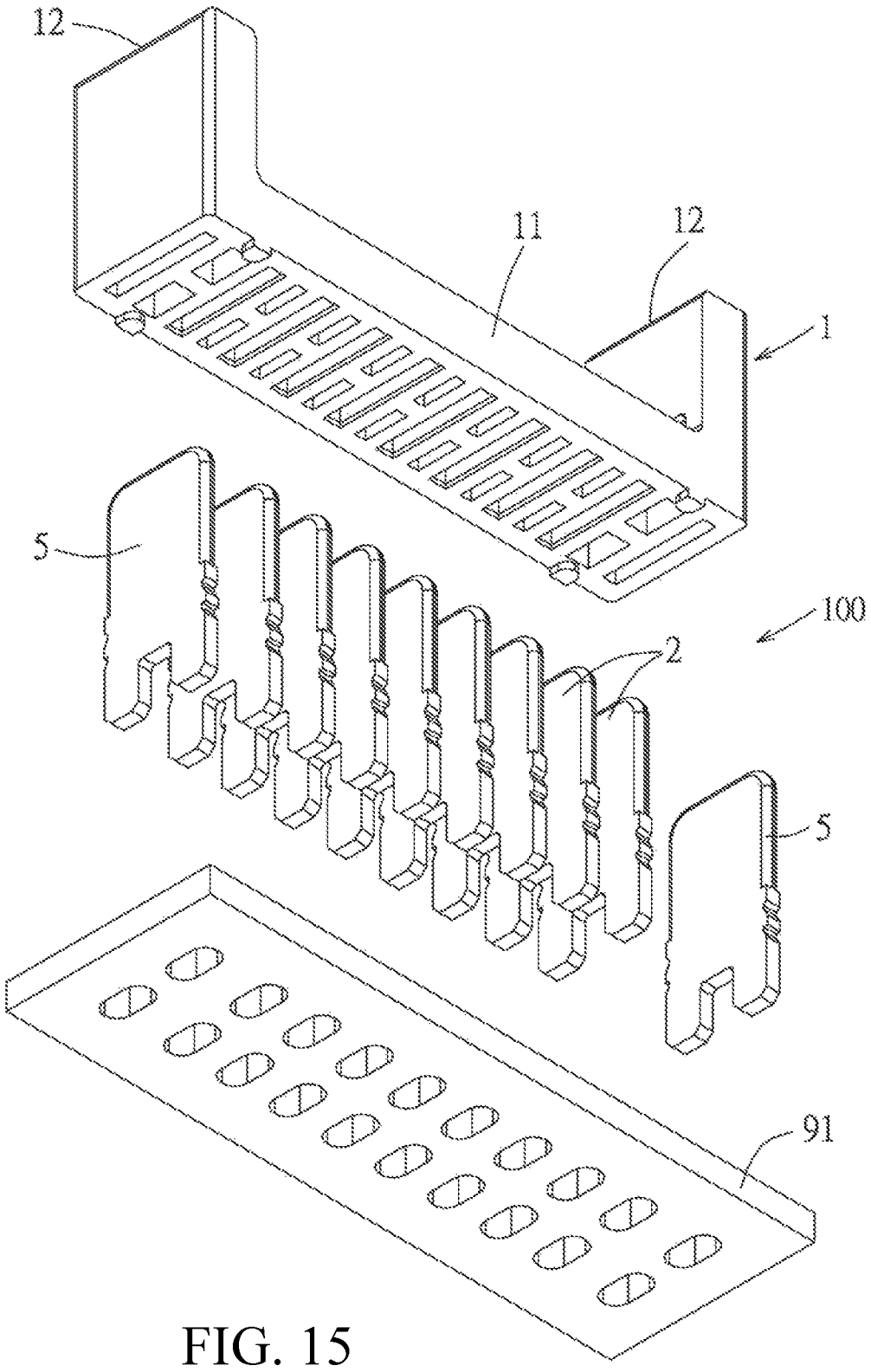
FIG. 15 is a view of FIG. 14 viewed from another angle.

Referring to FIG. 13 to FIG. 15, an electrical connection device of a second embodiment of the present disclosure is the substantially same as the first embodiment, but in the second embodiment, the two fixing members 5 of the first connector 100 are the same as the plurality of blade-type terminals 2 in structure, and the two fixing members 5 are respectively provided in the two ear portions 12 and pass through and protrude from the base portion 11. It may strengthen the structural strength of the ear portion 12 by that the fixing member 5 is provided in the ear portion 12. Moreover, in the embodiment, that the fixing member 5 is the same as the blade-type terminal 2 in structure is convenient to manufacture the fixing member 5. In other embodiments, the fixing member 5 may different from the blade-type terminal 2 in structure, as long as the two fixing members 5 can be respectively provided in the two ear portions 12 and protrude from the base portion 11 so to be soldered to the first circuit board 91, the present disclosure is not limited to this.

In conclusion, under guiding mating of the first connector 100 and the second connector 200 by that the first guide groove 13 or the second guide groove 14 of the first connector 100 engages with the protruding rail 33 of the second connector 200, whether the first connector 100 and the second connector 200 mate with each other in the first direction or the second direction, the contact portions 22 of the blade-type terminals 2 of the first connector 100 can respectively enter into the terminal grooves 324 respectively via the mating openings 324*a* of the terminal grooves 324 so as to prevent the elastic terminals 4 from being damaged. Moreover, the elastic terminal 4 may form the guide portion 42 extending in single direction by bending, the elastic terminal 4 is easy to manufacture and has stronger structural strength, and may bear high times of plug. In addition, the elastic terminal 4 has two soldering piece portions 45 offset and arranged side by side, it can increase the soldering area to make soldering more firm.

The above contents are only embodiment of the present disclosure and are not used to limit the implementing solutions of the present disclosure. Those skilled in the art may conveniently vary or modify based on the main concept and spirit of the present disclosure, therefore the extent of protection of the present disclosure shall be determined by the terms of the Claims.

What is claimed is:

1. An electrical connection device, comprising:

a first connector, comprising:

an insulating body having a base portion which is longitudinally long and two ear portions which perpendicularly protrude respectively from two ends of the base portion, are spaced apart from each other and face each other, an inner wall surface of one of the two ear portions being provided with a first guide groove which is perpendicular to the base portion and a second guide groove which is parallel to the base portion; and a plurality of blade-type terminals provided to the base portion along a longitudinal direction of the base portion, spaced apart from each other and positioned between the two ear portions, each blade-type terminal having a contact portion extending out of the base portion and positioned between the two ear portions; and a second connector, comprising:

an insulating housing having a mating portion and a protruding rail, the mating portion being correspondingly received between the two inner wall surfaces of the two ear portions of the first connector, and the mating portion having two long side surfaces respectively positioned at two sides of a longitudinal direction, two short side surfaces respectively positioned at two ends of the longitudinal direction and connecting the two long side surfaces, a top surface connecting the two long side surfaces and the two short side surfaces and a plurality of terminal grooves spaced apart from each other along the longitudinal direction of the mating portion, each terminal groove having a mating opening at the top surface and a side opening at one of the two long side surfaces, the protruding rail protruding from one of the two short side surfaces and extending in a direction perpendicular to the top surface to engage with the first guide groove or the second guide groove; and a plurality of elastic terminals provided to the insulating housing and respectively received in the plurality of terminal grooves, each elastic terminal having a contact portion positioned in the mating portion and a guide portion extending from the contact portion toward the top surface;

when the first connector and the second connector mate with each other in a first direction, under guiding due to engagement of the first guide groove of the first connector and the protruding rail of the second connector, the contact portions of the plurality of blade-type terminals respectively entering into the plurality of terminal grooves respectively via the mating openings of the plurality of terminal grooves and each contact portion can firstly contact the guide portion of the corresponding elastic terminal and then contact the contact portion of the corresponding elastic terminal;

when the first connector and the second connector mate with each other in a second direction, under guiding due to engagement of the second guide groove of the first connector and the protruding rail of the second connector, the contact portions of the plurality of blade-type terminals respectively entering into the plurality of terminal grooves respectively via mating openings of the plurality of terminal grooves and each contact portion can firstly contact the guide portion of the corresponding elastic terminal and then contact the contact portion of the corresponding elastic terminal.

2. The electrical connection device according to claim 1, wherein the protruding rail is adjacent to the long side surface provided with the side openings of the plurality of terminal grooves, the mating portion cannot enter into between the two ear portions from the long side surface provided with the side openings of the plurality of terminal grooves, so as to prevent the plurality of blade-type terminals from respectively entering into the plurality of terminal groove respectively via the plurality of side openings.

3. The electrical connection device according to claim 1, wherein an inner wall surface of the other ear portion of the insulating body is also provided with a first guide groove which is perpendicular to the base portion and a second guide groove which is parallel to the base portion, the two first guide grooves of the two ear portions are aligned with each other in position and the two second guide grooves of the two ear portions are aligned with each other in position; the insulating housing further has a protruding rail protruding from the other short side surface, the two protruding rails are aligned with each other in position.

4. The electrical connection device according to claim 3, wherein the two protruding rails are adjacent to the long side surface provided with the side openings of the plurality of terminal grooves, the mating portion cannot enter into between the two ear portions from the long side surface provided with the side openings, so as to prevent the plurality of blade-type terminals from respectively entering into the plurality of terminal grooves respectively via the plurality of side openings.

5. The electrical connection device according to claim 1, wherein each elastic terminal has a group of elastic clamping arms which face each other and extend toward the top surface, a distal section of each of the elastic clamping arms which are positioned respectively at two facing sides is firstly bent inwardly toward the inside of the two facing sides and then bent outwardly toward the outside of the two facing sides along an extension direction of the distal section and extends to form the contact portion and the guide portion, the contact portion of the elastic terminal is used for clamping the contact portion of the corresponding blade-type terminal.

6. The electrical connection device according to claim 5, wherein each elastic terminal further has a fixed portion and two soldering piece portions, the fixed portion has two main sections spaced apart from each other and facing each other and a connecting section connecting the two main sections, the group of elastic clamping arms respectively extend from the two main sections toward the top surface, the two soldering piece portions respectively extend from the two main sections toward a direction away from the top surface, and the two soldering piece portions are firstly bent relative to each other so as to approach each other and then extend straight, and the two soldering piece portions are offset and arranged side by side.

7. The electrical connection device according to claim 1, wherein the first connector further comprises two fixing members respectively provided in the two ear portions and passing through and protrude from the base portion.

8. The electrical connection device according to claim 7, wherein the two fixing members are the same as the plurality of blade-type terminals in structure.

9. A terminal integrally formed by a metal sheet, comprising:

a fixed portion having two main sections which are spaced apart from each other and face each other and a connecting section connecting the two main sections;

a group of elastic clamping arms which each extend from one side of one of the two main sections; and two soldering piece portions which each extend from another side of one of the two main sections toward a direction opposite to the group of elastic clamping arms, and the two soldering piece portions are firstly bent relative to each other so as to approach each other and then extend straight, and the two soldering piece portions are offset and arranged side by side.

10. The terminal according to claim 9, wherein a distal section of each of elastic clamping arms which are positioned respectively at two facing sides is firstly bent inwardly toward the inside of the two facing sides and then bent outwardly toward the outside of the two facing sides along an extension direction of the distal section and extends to form a contact portion and a guide portion.

* * * * *